US005618221A

United States Patent [19]

Furukawa et al.

[11] Patent Number: 5,618,221

[45] Date of Patent: Apr. 8, 1997

[54] METHOD OF DRESSING GRINDSTONE FOR NC GRINDER

[75] Inventors: Masahiro Furukawa; Masaaki Nagaya; Tatsuhiro Yoshimura, all of Aichi, Japan

[73] Assignee: Okuma Corporation, Aichi, Japan

[21] Appl. No.: 376,242

[22] Filed: Jan. 23, 1995

[30] Foreign Application Priority Data

Jan. 25, 1994 [JP] Japan ..... 6-023762

[51] Int. Cl.[6] ..... B24B 49/00

[52] U.S. Cl. ..... 451/8; 451/10; 451/56; 451/443

[58] Field of Search ..... 451/5, 8, 10, 11, 451/56, 443; 125/11.01

[56] References Cited

U.S. PATENT DOCUMENTS 3,641,714 2/1977 Asano .
4,391,066 7/1983 Munekata et al. .

*Primary Examiner*—Eileen P. Morgan
*Attorney, Agent, or Firm*—Dickstein Shapiro Morin & Oshinsky LLP

[57] ABSTRACT

A dressing method comprises the steps of rotating a rotary dresser at a high speed for dressing a surface of the grindstone, previous to contact of the rotary dresser with the surface of the grindstone, and detecting a rotational vibration caused by a bearing adapted to support the rotary dresser in rotation, by use of a vibration sensor for detecting a contact vibration having a specific frequency band generated when the rotary dresser in rotation comes into contact with the grindstone. Providing that the rotational vibration has been detected, an output signal from the vibration sensor is judged to be active, allowing the grindstone to be dressed. Prior to the execution of the dressing, failures in the vibration sensor and other deficiencies are detected.

6 Claims, 5 Drawing Sheets

METHOD OF DRESSING GRINDSTONE FOR NC GRINDER

BACKGROUND OF THE INVENTION

1. Field of the Invention

The present invention relates generally to a method of dressing a grindstone used in an NC (numerically controlled) grinding machine, and more particularly to a dressing method allowing a rotary dresser to cut into the grindstone at a precise position.

2. Description of the Related Arts

A typical NC grinding machine includes a grindstone formed from ultra-abrasive grains such as diamond or CBN (cubic boron nitride). The grindstone having the ultra-abrasive grains has two or three times the hardness of a conventional one formed from general-abrasive grains such as aluminum oxide (alumina) or silicon carbide, and is resistant to abrasion and fragmentation, and is therefore suitable for efficiently grinding a workpiece with close dimensional tolerances. Also, due to the high abrasion resistance of the ultra-abrasive grains, a binder is allowed to have a higher strength, with the result that the diameter of the grindstone hardly varies and hence machining dimensions of the workpiece can be stabilized.

Since the grindstone having the ultra-abrasive grains is more expensive compared with the general grindstone, it is preferable to effectively dress the former with a minimum dressing amount. For this reason, in the case of dressing the grindstone having the ultra-abrasive grains in the NC grinding machine, a rotary dresser must cut into the grindstone at a precise position.

However, a distance between the rotary dresser and the grindstone during dressing may vary depending on a thermal expansion of the NC grinding machine caused by heat generated during grinding, or on a thermal shrinkage thereof caused by a change in the ambient temperature. If the distance is short, the depth of cut made by the rotary dresser may become too large, whereas if the distance is long, it is possible that no dressing may be performed since the rotary dresser does not come into contact with the grindstone. In the case where the dressing fails because of non-contact, for example, in an automated production line, the products may have poor surface finishes, leading to damage along the production line.

Thus, in the prior art, to ensure that the rotary dresser cuts into the grindstone at a precise position, contact of the rotary dresser with the grindstone is detected, and the detected position of the point of contact is used to correct an NC command value for specifying a position of the rotary dresser, issued from a numerical controller. A vibration sensor is mounted on the rotary dresser unit for detecting the contact of the rotating rotary dresser with the grindstone.

In a method of correcting the NC command value by means of the vibration sensor in this manner, if a failure occurs in the vibration sensor, or there is a break or defective contact in connection cables, the rotary dresser may continue to advance toward the grindstone, thereby damaging the grindstone or the rotary dresser itself. Further, if a droplet of, for example, the coolant touches a detection part of the vibration sensor, a contact signal may be generated irrespective of actual non-contact of the rotary dresser with the grindstone, resulting in an insufficient dressing operation.

SUMMARY OF THE INVENTION

It is therefore an object of the present invention to provide a grindstone dressing method capable of realizing reliable dressing by detecting, previous to the execution of a dressing operation, a failure in a vibration sensor, or a break or defective contact in connection cables.

Another object of the present invention is to provide a grindstone dressing method ensuring dependable dressing by confirming, subsequent to the execution of a dressing operation, that the dressing has been positively carried out.

According to a first aspect of the present invention, there is provided a method of dressing a grindstone in an NC grinding machine, the method comprising the steps of rotating a rotary dresser for dressing a surface of the grindstone at a high speed, previous to contact of the rotary dresser with the surface of the grindstone, and detecting a rotational vibration generated from a bearing supporting the rotary dresser in rotation, by use of a vibration sensor for detecting a contact vibration having a specific frequency band generated when the rotating rotary dresser comes into contact with the grindstone, wherein if the rotational vibration is detected, an output signal from the vibration sensor is judged to be active, allowing the grindstone to be dressed.

In this method, if a rotational vibration arising from the bearing is detected by the use of the vibration sensor, it is judged that the output signal from the vibration sensor is active, and the dressing of the grindstone is allowed to be executed. By virtue of this, a failure in the vibration sensor or a break or defective contact of the connection cables can be detected, previous to the execution of the dressing operation, thereby preventing the rotary dresser from excessively cutting into the grindstone. Thus, reliable dressing can be realized. In this case, the frequency band of the rotational vibration is substantially the same as a specific frequency band of the contact vibration of the rotary dresser rotating in contact with the surface of the grindstone, so that the vibration sensor necessary for the detection of a position where the rotating rotary dresser comes into contact with the grindstone can be utilized for detecting the rotational vibration.

According to a second aspect of the present invention, there is provided a method of dressing a grindstone in an NC grinding machine, the method comprising: the steps of dressing a surface of the grindstone by bringing the rotating rotary dresser into contact with the surface of the grindstone, and thereafter grinding a workpiece by bringing the surface of the grindstone into contact with the workpiece; and detecting a load of a grindstone axle motor for rotationally driving a grindstone axle carrying the grindstone thereon, wherein if the load thus detected is greater than a load value previously set, the dressing is judged to have been positively performed, allowing the grinding to be continued.

Such a method will provide confirmation on whether the dressing has been positively carried out or not, while simultaneously executing the grinding work. This will also securely prevent a product from having a poor surface finish.

The above and other objects, features and advantages of the present invention will become more apparent from the following description of preferred embodiments read in conjunction with the accompanying drawings.

DESCRIPTION OF THE PREFERRED EMBODIMENTS

An embodiment of the present invention will now be described with reference to the accompanying drawings.

Figure 1:
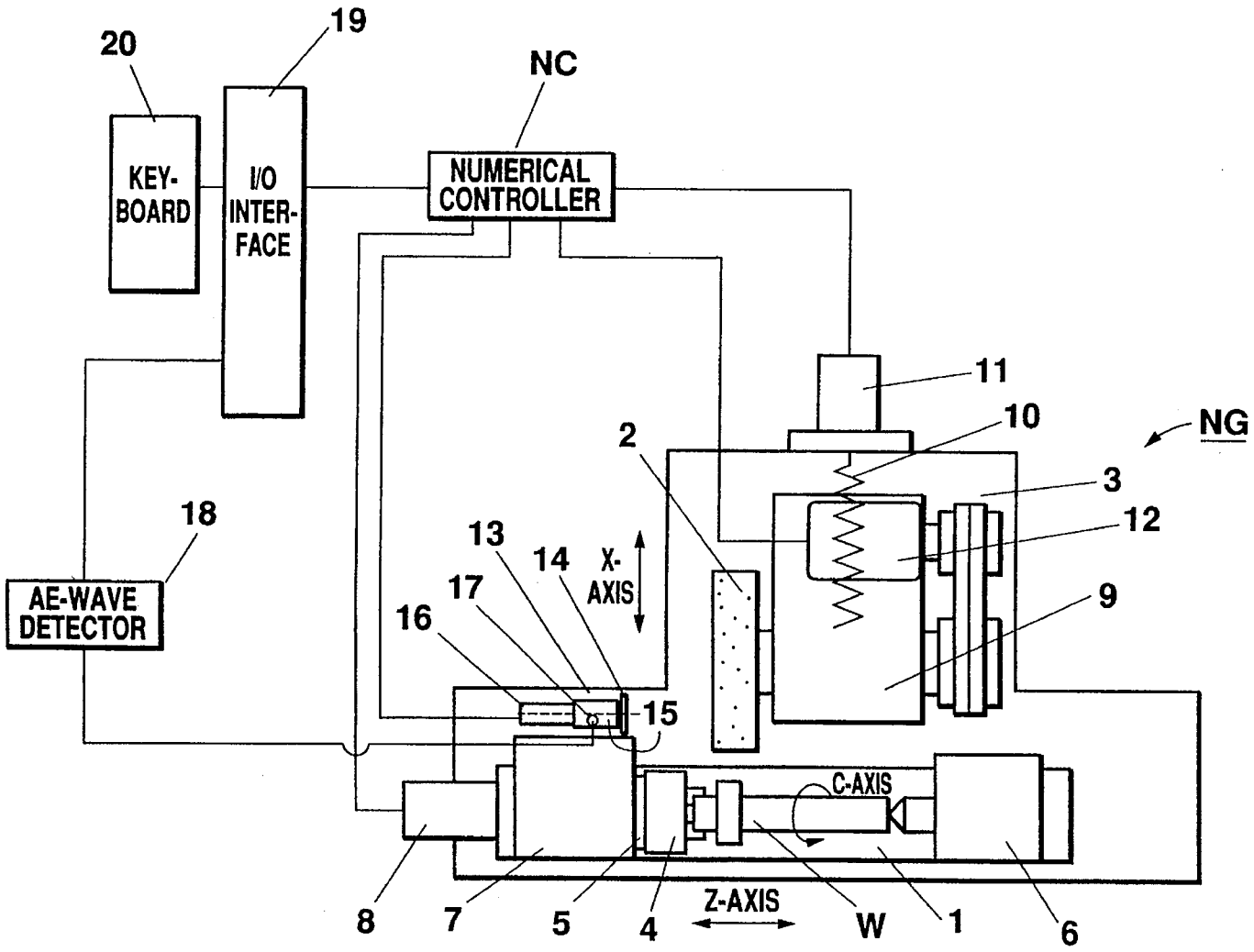
FIG. 1 depicts an overall configuration of an NC grinding machine in accordance with the present invention.

In FIG. 1, an NC grinding machine NG grinds a workpiece W by bringing a rotating grindstone 2 into contact with the workpiece W and rotating the workpiece W supported on a table 1. The table 1 is mounted on a bed 3 fixed to a floor surface in such a manner that the table 1 is displaceable in the direction (Z-axis direction) along the rotational axis of the workpiece W. A Z-axis servomotor, not shown, is connected to the table 1 by means of a ball thread, also not shown, the table 1 being positioned by the rotation of the servomotor.

Disposed on the table 1 are a main spindle 5 having a chuck 4 attached to the extremity of the main spindle 5 to hold one end of the workpiece W, and a tailstock 6 for rotatably supporting the other end of the workpiece W. The main spindle 5 is carried by a headstock 7 disposed on the table 1. A main spindle motor 8 provides a rotation to the main spindle 5, allowing the workpiece W to rotate around the C-axis.

The grindstone 2 is rotatably carried by a wheel spindle stock 9. The wheel spindle stock 9 is mounted on the bed 3 in such a manner as to be displaceable in the direction (X-axis direction) orthogonal to the rotational axis of the workpiece W. An X-axis motor 11 is coupled to the wheel spindle stock 9 by means of a ball thread 10, the wheel spindle stock 9 being positioned by the rotation of the X-axis motor 11.

The grindstone 2 is formed from ultra-abrasive grains such as, for example, diamond or CBN bound with a binder. The grindstone 2 is rotated by a grindstone motor 12.

A numerical controller NC controls the rotation of the Z-axis servomotor to displace the table 1 to determine the feed rate of the workpiece W, and controls the rotation of the X-axis motor 11 to displace the wheel spindle stock 9 to determine the infeed of the grindstone 2. The numerical controller NC also serves to detect the power consumption of the grindstone motor 12. The numerical controller NC further controls the rotation of the main spindle motor 8 to determine the amount of rotation or the speed of rotation of the workpiece W.

At the side of the main spindle stock 7, a dressing unit 13 is attached for dressing the surface of the grindstone 2. The dressing unit 13 is provided with a rotary dresser 14 adapted to come into contact with the surface of the grindstone 2 during rotation. The rotary dresser 14 is rotatably supported on a housing 15 by way of a bearing, not shown, and is rotationally driven through a motor 16 which is also controlled by the numerical controller NC.

A vibration sensor 17 is attached to the housing 15 for detecting vibration of the housing 15 caused by the rotation of the rotary dresser 14. The vibration sensor 16 detects contact vibration of a specific frequency band generated when the rotating rotary dresser 14 is brought into contact with the grindstone 2. A detection signal from the vibration sensor 17 is amplified by an AE-wave detector 18, and is then input via an I/O interface 19 to the numerical controller NC. A keyboard 20 is coupled to the I/O interface 19, for supplying data to the numerical controller NC.

Figure 2:
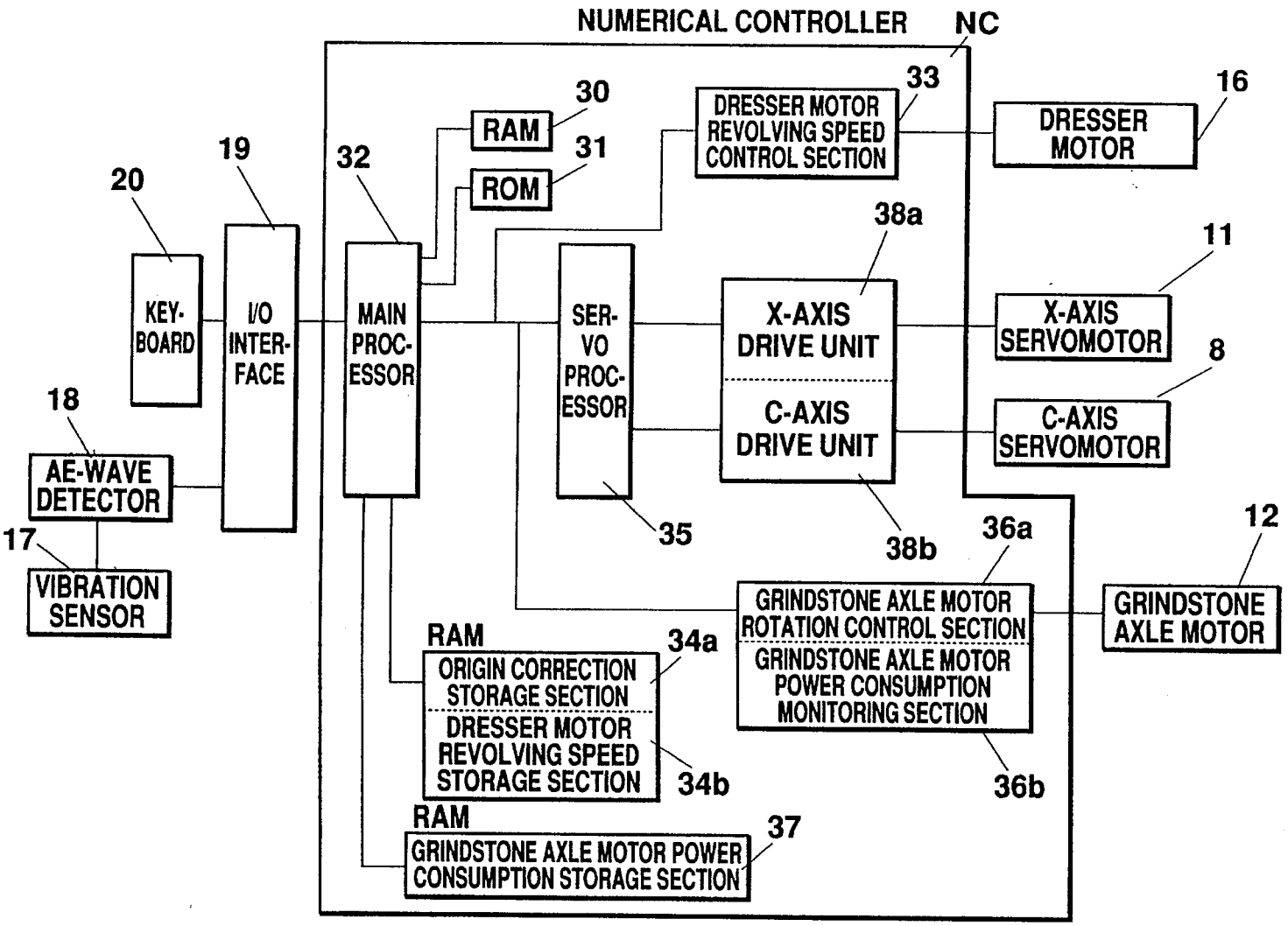
FIG. 2 is a block diagram of an NC servo system within the NC grinding machine.

FIG. 2 depicts a configuration of an NC servo system incorporated into the NC grinding machine NG. In this servo system, to control the motors 8, 11, 12 and 16, a main processor 32 processes axis control variables and machining programs stored within a first RAM 30, and axis control software read from a ROM 31 upon the power supply.

The rotation of the dresser motor 16 is controlled by a dresser motor revolving speed control section 33. Such control is effected by reading, through the main processor 32, a dresser motor revolving speed stored in a dresser motor revolving speed storage section **34*b* within a second RAM 34**.

The X-axis servomotor 11 is controlled by electric power supplied from an X-axis drive unit **38*a*. The electric power to be supplied is controlled by an axis feed command issued from a servo processor 35. In order to obtain the axis feed command, the servo processor 35 subjects an axis feed command derived from the main processor 32 to acceleration/deceleration processing. The main processor 32 issues an axis feed command based on an origin correction value stored in an origin correction amount storage section 34*b* within the second RAM 34. The origin correction amount storage section 34*b* serves to store, as the origin correction value, a difference between a position detected when the rotary dresser 14 comes into contact with the grindstone 2** and a command value issued in the form of the axis feed command.

Through the servo processor 35, the main processor 32 simultaneously supplies another axis feed command to a C-axis drive unit **38*b*. In response to this axis feed command, the C-axis servo motor 8 is controlled. The rotation of the grindstone axle motor 12 is controlled by a grindstone axle motor rotation control section 36*a*. The power consumption of the grindstone axle motor 12 is read by a power consumption monitoring section 36*b*, and the thus read value is stored within a third RAM 37**.

Figure 3:
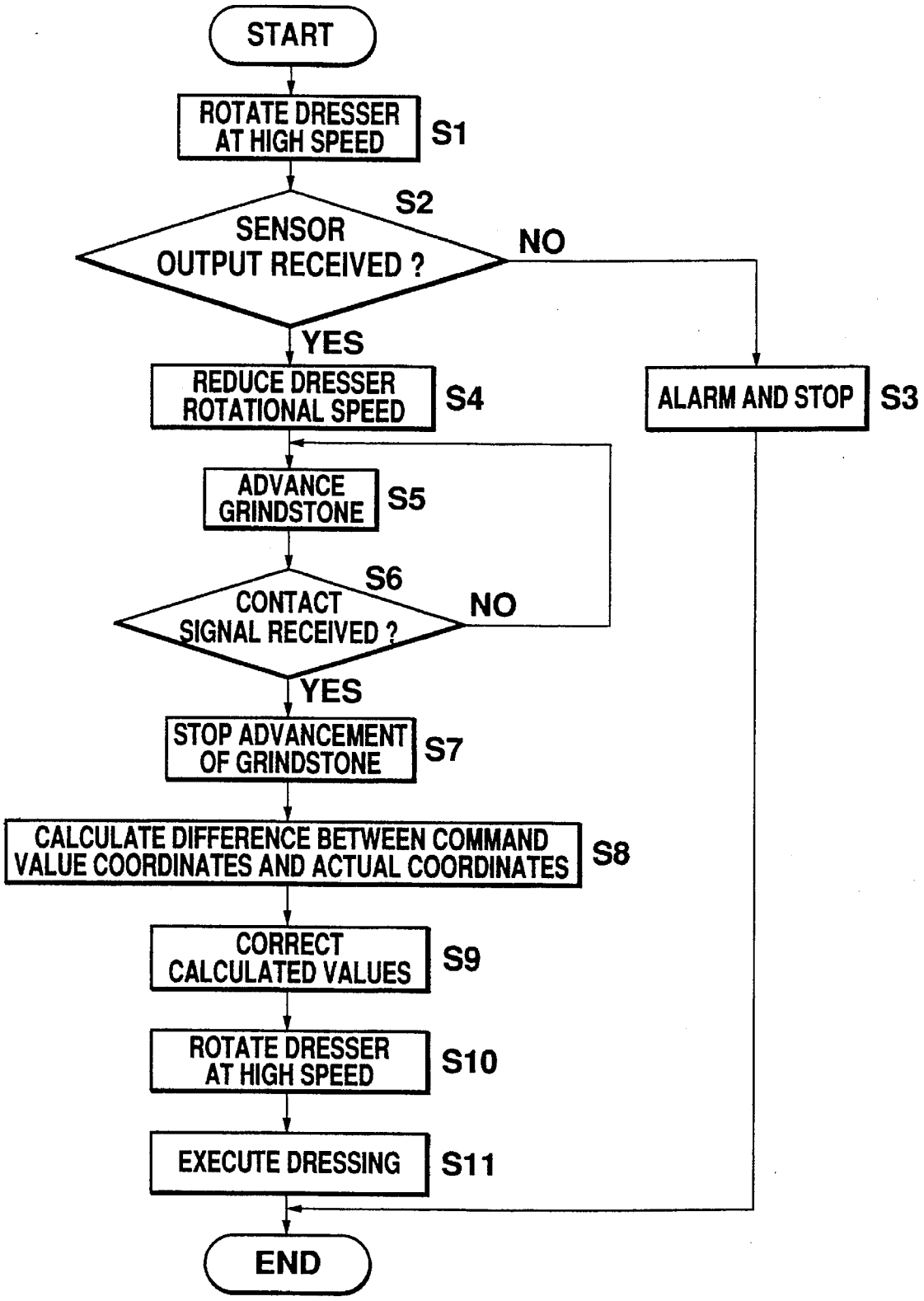
FIG. 3 is a flowchart showing an operation of confirming the detection of contact of a rotary dresser with a grindstone.

An operation of dressing the grindstone 2 by means of the rotary dresser 14 will be described with reference to a flowchart depicted in FIG. 3.

First, when a command for the execution of a dressing operation is issued in compliance with a numerical control program, the rotary dresser 14 is driven to rotate at a high speed in the first step S1, previous to the contact of the rotary dresser 14 with the surface of the grindstone 2. It is judged in the second step S2 whether the vibration sensor 17 has generated a detection signal or not. At that time, a bearing for supporting the rotating rotary dresser 14 will undergo a rotational vibration having substantially the same frequency band as that of contact vibration which will be generated upon contact of the rotary dresser 14 with the grindstone 2. For this reason, the vibration sensor 17 required to detect a position at which the rotating rotary dresser comes into contact with the grindstone can be utilized for the detection of the rotational vibration. If no output from the vibration sensor 17 is detected in the second step S2, it is judged that the vibration sensor 17 is out of order or that the connection cables suffer a break or a contact failure, whereupon in the third step S3 the execution of the dressing is canceled and the operator is informed of it through a buzzer or an alarm lamp.

If an output from the vibration sensor 17 is detected in the second step S2, the output from the vibration sensor 17 is judged to be active, permitting the execution of a dressing operation in the subsequent steps. More specifically, in the fourth step S4, the rotation of the rotary dresser 14 is temporarily slowed down. This will prevent the vibration sensor 17 from erroneously detecting the rotational vibration analogous to the contact vibration. In the fifth step S5, the grindstone 2 is advanced, and if contact vibration is detected by the vibration sensor 17 in the sixth step S6, then in the seventh step S7 the advancement of the grindstone 2 is stopped. In the eighth step S8 the main processor 32 calculates differences between X-axis command value coordinates at the time of contact, and actual coordinates. The results of calculation are stored within the second RAM 34. Afterwards, in the ninth step S9, the results of calculation are used as origin correction values to correct the coordinates on the coordinate system. This will ensure an infeed of the rotary dresser 14 at a precise position. Subsequently, the rotary dresser is rotated at a high speed for executing a dressing operation (the tenth step S10).

Figure 4:
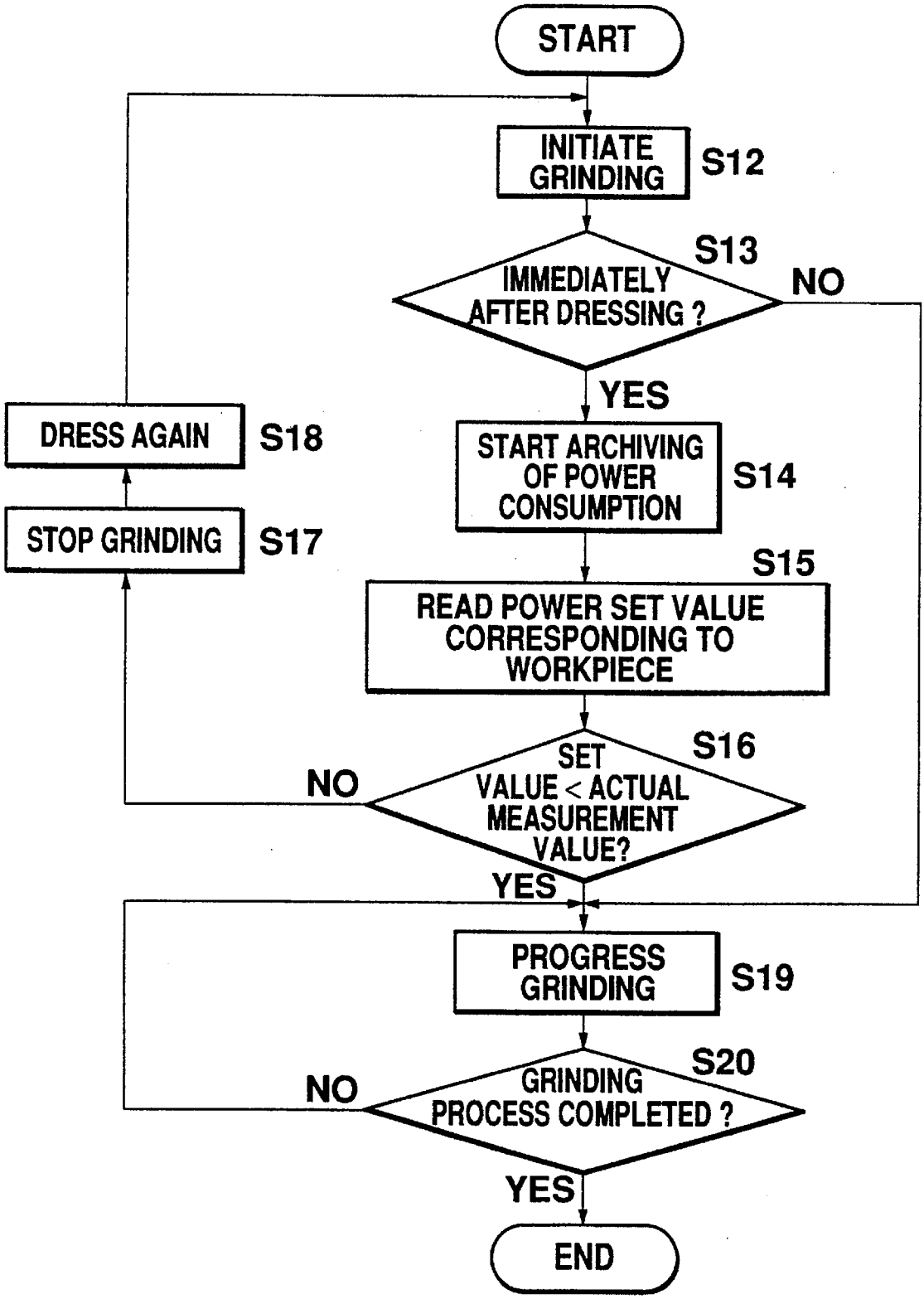
FIG. 4 is a flowchart showing an operation of confirming the completion of execution of a dressing operation.
Figure 5:
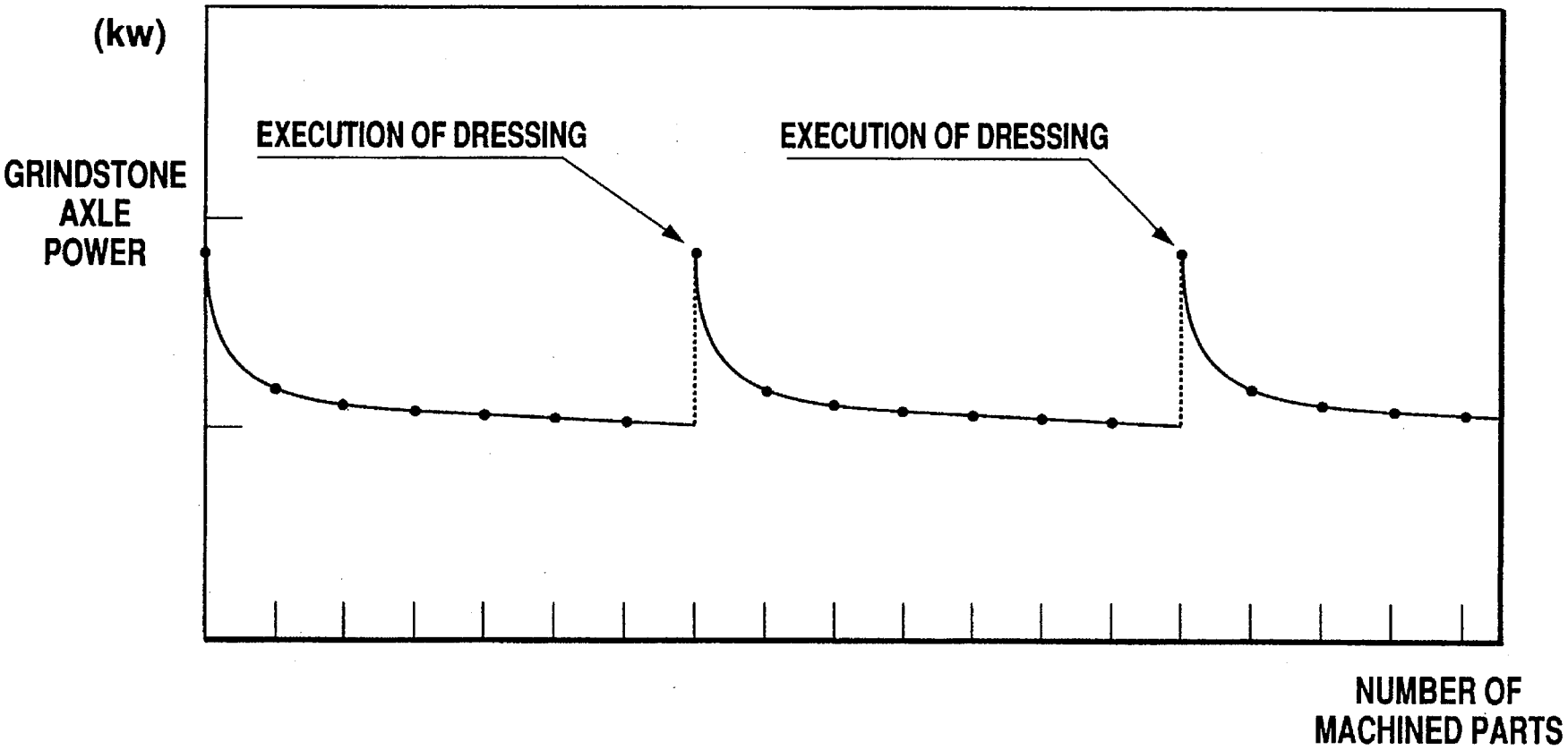
FIG. 5 is a graph representing a relationship between power consumption of a grindstone axle motor during a grinding operation and the number of machined parts.

After the completion of the dressing, grinding work of a workpiece W will be initiated. At the same time, it is also to be confirmed, through the following procedures, whether the dressing operation has been positively performed or not. In FIG. 4, after the execution of dressing, the grindstone is brought into contact with the workpiece W to initiate the grinding work (the twelfth step S12). It is then confirmed, in the thirteenth step S13, whether it is immediately after the dressing has been executed. If it is judged to be immediately after the execution of the dressing, values of power consumption of the grindstone axle motor 12 are detected as its loads, in the fourteenth step S14, to store the maximum as an actual measurement value. In the fifteenth step S15, a preset electrical power value is read out from the third RAM 37. The electrical power value is previously set based on a graph depicted in FIG. 5 representing a relationship between power consumption values of the grindstone axle motor 12 and the number of ground workpieces W. As can be seen from this graph, the grindstone axle motor 12 presents remarkably great power consumption values immediately after the execution of the dressing operation. This is a phenomenon peculiar to the ultra-abrasive grains grindstone, different from the general grindstone such as alumina or silicon carbide, and arises from the fact that surplus binder tends to adhere around the abrasive grains immediately after the execution of dressing, preventing the cutting edges from sufficiently protruding. Thereafter, with the progress of the grinding work, the binder will be gradually removed to lower the power consumption. Thus, by detecting a peak value of the power consumption immediately after the execution of dressing, it is possible to judge whether the dressing has been positively performed or not.

In the sixteenth step S16, an actual measurement value is compared with a power value which has been set to be smaller than the peak value, and if the former is less than the latter, it is judged that the dressing has not been correctly performed. In this case, the grinding work is immediately stopped in the seventeenth step S17, and the dressing is again performed in the eighteenth step S18. If the actual value is larger than the power value, it is judged that the dressing has been correctly performed, allowing the grinding work to be continued (the nineteenth step S19). This processing may be carried out at predetermined intervals, or alternatively may be done only when a dressing execution command has been issued.

What is claimed is:

1. A method of dressing a grindstone in an NC grinding machine, said method comprising the steps of:

providing a rotary dresser for dressing a surface of said grindstone;

providing a vibration sensor;

rotating said rotary dresser at a high speed;

while rotating said rotary dresser at said high speed, using said vibration sensor to detect rotational vibration generated by said rotary dresser; and subsequently, causing said rotary dresser to come into contact with said surface of said grindstone.

2. A method of dressing a grindstone in an NC grinding machine according to claim 1, wherein said rotary dresser is supported by a bearing, and wherein said rotational vibration is generated from said bearing.

3. A method of dressing a grindstone in an NC grinding machine according to claim 1, wherein said step of using said vibration sensor includes the step of generating an output signal, and wherein said step of causing said rotary dresser to come into contact with said surface of said grindstone occurs subsequent to said step of generating said output signal.

4. A method of dressing a grindstone in an NC grinding machine according to claim 3, wherein contact vibration is generated when said rotary dresser comes into contact with said surface of said grindstone, and wherein said vibration sensor is arranged to detect said contact vibration.

5. A method of dressing a grindstone in an NC grinding machine according to claim 4, wherein the frequency of said rotational vibration is substantially the same as the frequency of said contact vibration.

6. A method of dressing a grindstone in an NC grinding machine according to claim 5, further comprising the step of reducing the rotational speed of said rotary dresser after said output signal is generated and before said rotary dresser comes into contact with said surface of said grindstone.

* * * * *